US007351161B2

(12) United States Patent
Beach

(10) Patent No.: US 7,351,161 B2
(45) Date of Patent: Apr. 1, 2008

(54) SCIENTIFICALLY ADAPTABLE DRIVER

(76) Inventor: Adam Beach, 510 Holmes Blvd., Yorktown, VA (US) 23692

( * ) Notice: Subject to any disclaimer, the term of this patent is extended or adjusted under 35 U.S.C. 154(b) by 47 days.

(21) Appl. No.: 11/328,763

(22) Filed: Jan. 10, 2006

(65) Prior Publication Data

US 2006/0154747 A1 Jul. 13, 2006

Related U.S. Application Data

(60) Provisional application No. 60/642,739, filed on Jan. 10, 2005.

(51) Int. Cl.
*A63B 53/04* (2006.01)
*A63B 53/06* (2006.01)

(52) U.S. Cl. ..... 473/334; 473/336; 473/346

(58) Field of Classification Search ..... 473/324–350, 473/312, 256

See application file for complete search history.

(56) References Cited

U.S. PATENT DOCUMENTS 1,133,129 A * 3/1915 Govan ..... 473/337
1,518,316 A * 12/1924 Ellingham ..... 473/337
3,652,094 A * 3/1972 Glover ..... 473/337
3,979,122 A * 9/1976 Belmont ..... 473/336
4,607,846 A * 8/1986 Perkins ..... 473/336
5,013,041 A * 5/1991 Sun et al. ..... 473/252
6,306,048 B1 * 10/2001 McCabe et al. ..... 473/333
7,108,609 B2 * 9/2006 Stites et al. ..... 473/256
7,108,611 B2 * 9/2006 MacIlraith ..... 473/288
7,201,669 B2 * 4/2007 Stites et al. ..... 473/337

* cited by examiner

*Primary Examiner*—Sebastiano Passaniti
(74) *Attorney, Agent, or Firm*—George F. Helfrich

(57) ABSTRACT

An improved golf ball driver has a first weight positioned within the clubhead of the driver, and a first means for adjusting the first weight in a generally vertical direction within the clubhead, that is, from top to bottom thereof. The improved driver also has a second weight positioned within the clubhead, and a second means for adjusting the second weight in a generally horizontal direction within the clubhead, that is from the heel to the toe thereof. Adjusting the weights allows a golfer to eliminate natural swing problems and/or to make a desired change in the flight pattern of a golf ball when it is struck by the driver.

4 Claims, 3 Drawing Sheets

SCIENTIFICALLY ADAPTABLE DRIVER

CROSS REFERENCE TO RELATED APPLICATION

This application claims the benefit of U.S. Provisional Application No. 60/642,739, filed Jan. 10, 2005.

BACKGROUND OF THE INVENTION

1. Field of the Invention

The present invention relates generally to golf clubs. It relates particularly to a driver which is scientifically adaptable to the swing of the user.

2. Description of the Related Art

Longer, straighter drives have been the desire of virtually every golfer. To that end, certain structural modifications to drivers have been devised and marketed over the years, especially in recent times. Howsoever efficacious, these expedients are found wanting, in that they do not provide for both vertical and horizontal weighting adjustments within the driver head, which adjustments have been found to be significant in adapting a driver to the swing of its user.

BRIEF SUMMARY OF THE INVENTION

The present invention provides for adjustment of both vertical and horizontal weighting within the head of a driver, thereby effectively eliminating natural swing problems, and/or effecting a desired change in the flight pattern of a golf ball when struck by the driver.

According to the present invention, an improved driver has a first weight positioned within the clubhead thereof, and a first means for adjusting the first weight in a generally vertical direction therein, that is, from the top to the bottom thereof. The improved driver also has a second weight positioned within the clubhead, and a second means for adjusting the second weight in a generally horizontal direction within the clubhead, that is, from the heel to the toe thereof.

The first means for adjusting the first weight is advantageously a first sleeve securely positioned generally vertically within the clubhead and extending from the top to the bottom thereof. The first sleeve has a first threaded shaft for receiving and advancing or retracting the first weight therein, the first weight having threads thereon which mesh with threads of the threaded shaft of the first sleeve. The second means for adjusting the second weight is advantageously a second sleeve securely positioned generally horizontally within the clubhead and extending from the heel to the toe thereof. The second sleeve has a second threaded shaft for receiving and advancing or retracting the second weight therein, the second weight having threads thereon which mesh with threads of the threaded shaft of the second sleeve.

It is especially advantageous if the first and second sleeves have first and second shafts, respectively, which include threaded, as well as unthreaded areas therein. Moreover, especially beneficial results are obtained if these unthreaded areas are located adjacent to a point of attachment of the first and second sleeves respectively to the interior of the clubhead, and further if these unthreaded areas terminate respectively in access port holes in the clubhead. These access port holes are conveniently closed by port hole caps after adjustments have been made to the first and/or second weights by the user of the driver.

A most important accessory for the present invention is a cooperating adjustment tool, which has a handle, a shaft communicating with the handle, and an adjustment end located on the shaft at the end thereof opposite to the handle. This adjustment end is adapted to engage screw heads located on the first and second weights, respectively, so that these weights may be advanced or retracted through the first and second threaded shafts, respectively, by a golfer. The shaft of the adjustment tool is conveniently and advantageously provided with markings thereon which allow the golfer to know exactly the position of a weight within a sleeve inside the clubhead.

BRIEF DESCRIPTION OF THE SEVERAL VIEWS OF THE DRAWINGS

For a more complete understanding of the present invention, reference should be made to the Detailed Description, which is set forth below. This Detailed Description should be read together with the accompanying drawings, wherein.

DETAILED DESCRIPTION OF THE INVENTION

Figure 1:
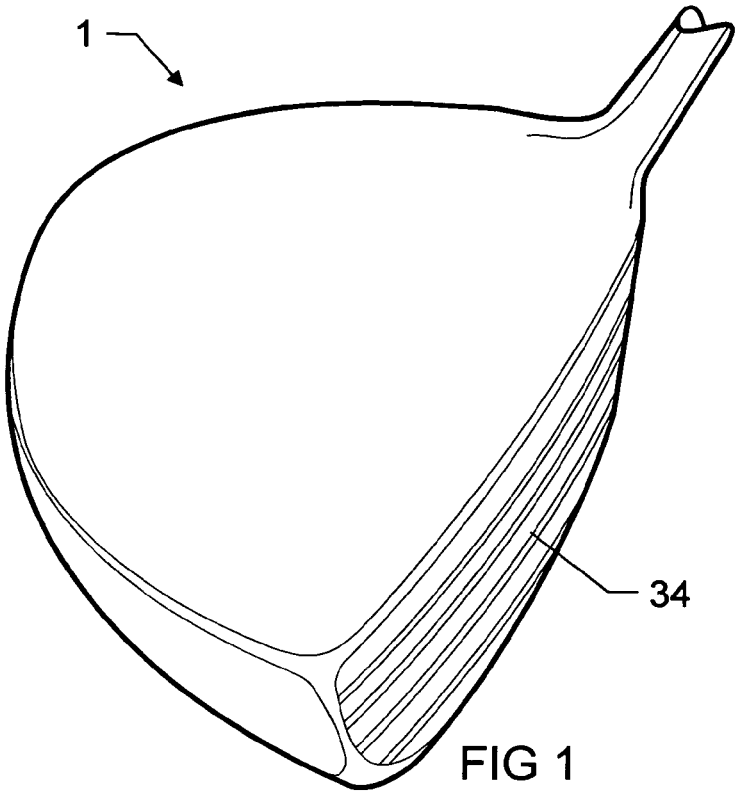
FIG. 1 is a perspective drawing showing the clubhead of an ordinary driver of the prior art.
Figure 2:
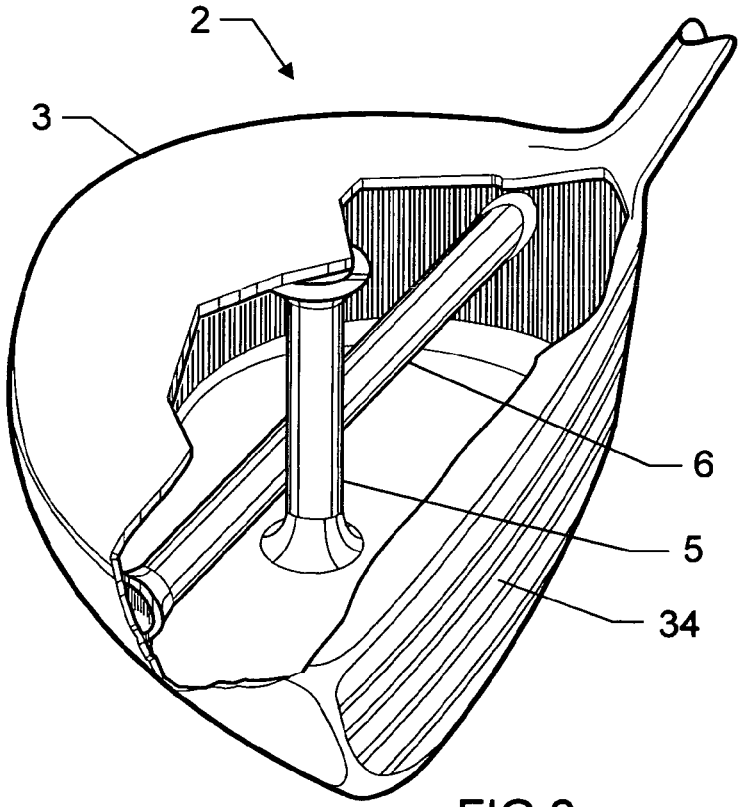
FIG. 2 is a cutaway perspective showing an improved driver according to the present invention.
Figure 3:
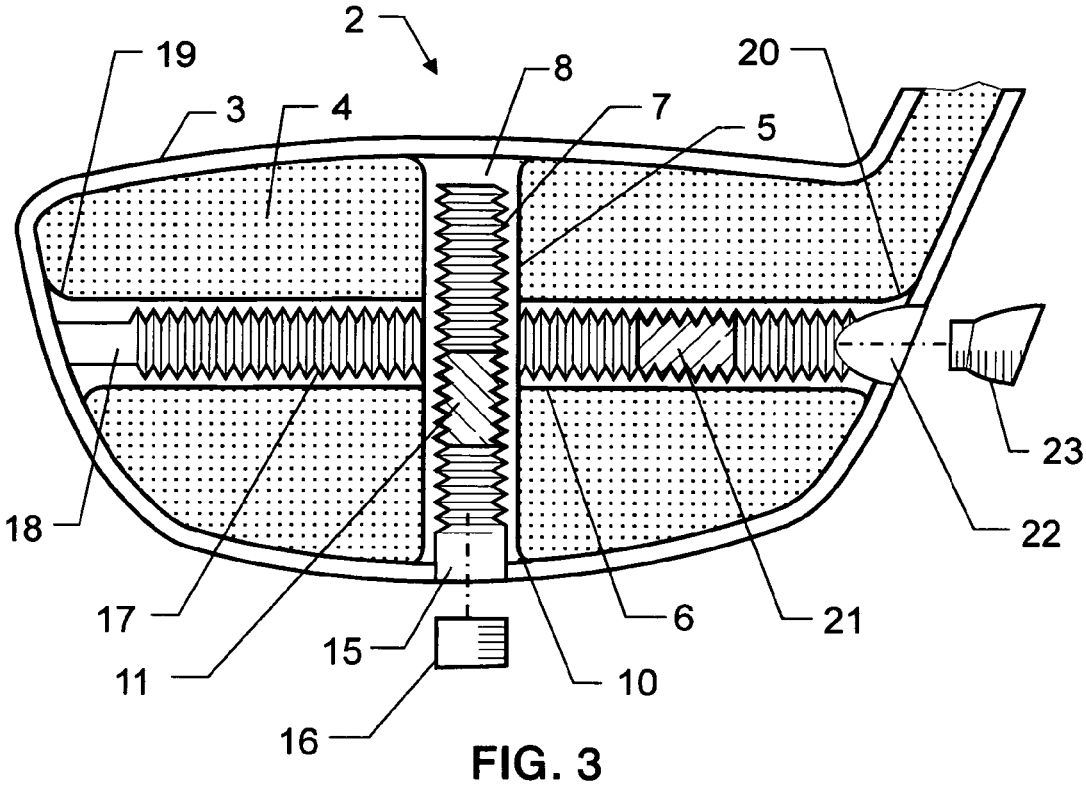
FIG. 3 is a cutaway side view showing structural detail of the driver of FIG. 2.

Referring now to the Drawings, FIG. 1 in perspective shows the clubhead 1 of an ordinary driver, and FIG. 2 is a cutaway perspective showing the clubhead 2 of a preferred embodiment of an improved driver according to the present invention. FIG. 3 is a cutaway showing structural detail of the clubhead 2 according to the present invention. External head shell 3 (e.g. of titanium) is essentially hollow, containing a filling 4, such as a polymeric foam. Located within head shell 3 are 2 conduits or sleeves, a first sleeve 5, securely positioned generally vertically and extending from the top to the bottom of the clubhead, and a second sleeve 6, securely positioned generally horizontally, and extending from the heel to the toe of the clubhead.

Figure 5:
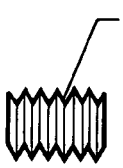
FIGS. 5-7 depict various weights which may be threaded into the shafts shown in FIG. 3.
Figure 6:
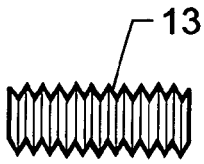
Figure 7:
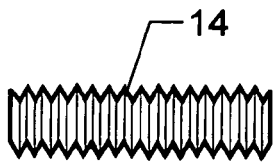

Sleeve 5 includes threaded shaft 7 and unthreaded area 8, and sleeve 5 is attached to clubhead 2 at attachment points 9 and 10. Located inside threaded shaft 7 is threaded weight 11, which may be, for example, a 4-gram weight 12 (FIG. 5), or an 8-gram weight 13 (FIG. 6), or a 12-gram weight 14 (FIG. 7). Threaded weight 11 may, of course, be heavier or lighter, as appropriately determined. Sleeve 5 also includes port hole access 15, which is closed with port hole cap 16.

Sleeve 6 includes threaded shaft 17 and unthreaded area 18, and sleeve 6 is attached to clubhead 2 at attachment points 19 and 20. Located inside threaded shaft 17 is threaded weight 21, which may be, for example, a 4-gram weight 12 (FIG. 5), or an 8-gram weight 13 (FIG. 6), or a 12-gram weight 14 (FIG. 7). Threaded weight 21 may, of course, be heavier or lighter, as appropriately determined. Sleeve 6 also includes port hole access 22, which is closed with port hole cap 23.

Figure 4:
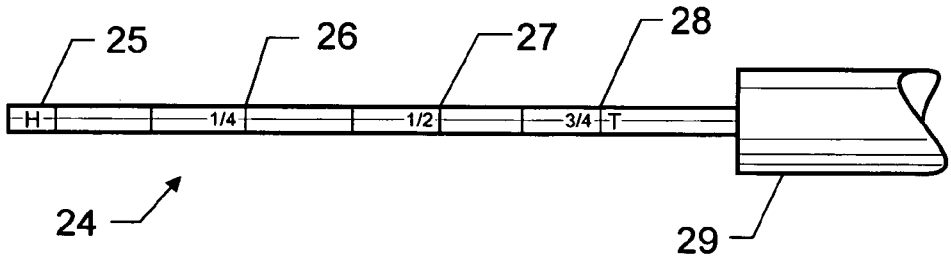
FIG. 4 is a schematic showing an adjustment tool which is employed in making adjustments of the vertical and/or horizontal weighting of the clubhead of the driver according to the present invention.

Referring now to FIG. 4 adjustments of the vertical and/or horizontal weighting of the clubhead 2 are accomplished by means of adjustment tool 24, which has an adjustment end 25 and a handle 26, and which has markings down the shaft thereof which allow a golfer to know how far a weight is being moved into a vertical or horizontal threaded shaft. These markings indicate, for example, ¼ of the length of the threaded shaft (at 26), ½ thereof (at 27), ¾ thereof (at 28), etc. Other systems of marking are of course possible to allow the golfer to know exactly where a weight is inside clubhead 2.

Figure 8:
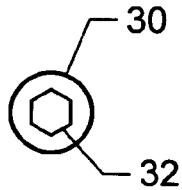
FIGS. 8-10 depict inserts for screw heads of the various weights shown in FIGS. 5-7.
Figure 9:
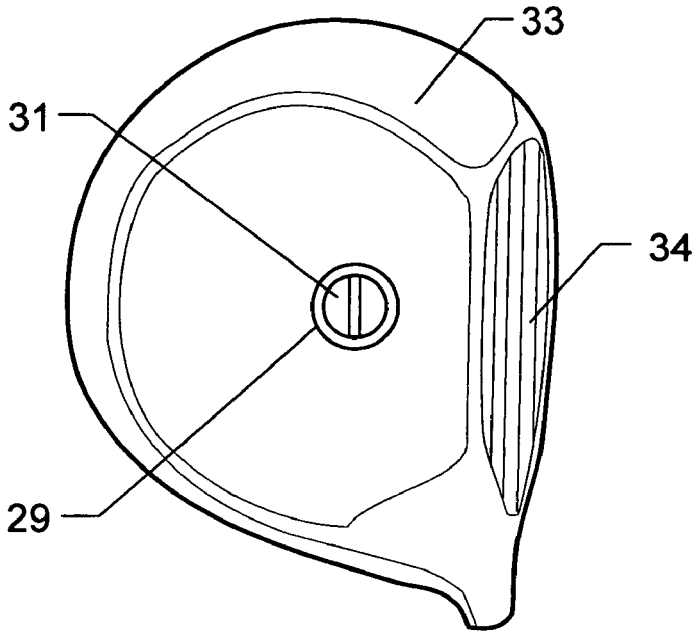
Figure 10:
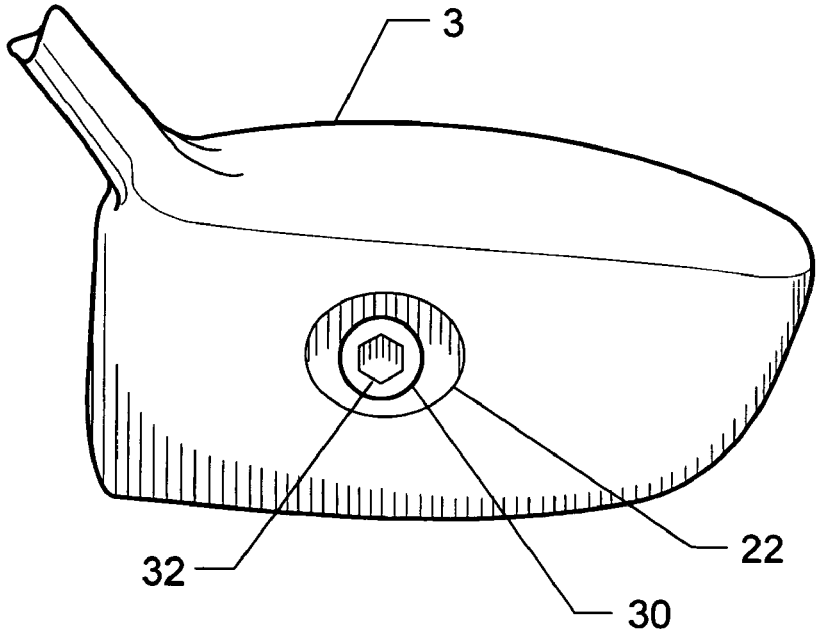

FIGS. 9 and 10 show screw heads 29 and 30, as well as their inserts 31 and 32, which may be hexagonal, as shown in FIGS. 8 and 10, or of other configurations, as shown in FIG. 9. These screw heads and their inserts are, of course, not visible when port hole caps 16 and 23 are in place. FIG. 9 also shows external head 33 and milled grooves 34.

When a golfer desires to adjust the vertical or horizontal weighting of a driver clubhead according to the present invention, in order to effectively eliminate natural swing problems or to effect some other desired change in the flight pattern of his/her golf ball, he or she first removes access port caps 16 and/or 23. Then adjustment tool 24 is employed to move threaded weights 11 and/or 21 from either bottom to top and/or from heel to toe of clubhead 2. Once the golfer has made appropriate adjustment(s), access port caps 16 and/or 23 are placed back into access ports 15 and 22.

Having described and pictured preferred embodiments of the present invention, it must be now noted that the vertical and horizontal sleeves may be oriented within the clubhead in positions which may vary from about 0-15 degrees and more from true vertical, and from about 0-15 degrees and more from true horizontal, respectively. Moreover, the vertical and horizontal sleeves may have various diameters, e.g., 5 mm, 10 mm, 15 mm. Furthermore, the thread lengths (i.e., how far apart one thread is from the next) of the threaded weights and corresponding threaded shafts may vary, as is understood by the skilled artisan. The sleeves and weights are advantageously constructed from titanium, aluminum, construction plastics, and nylon, as understood by the skilled artisan. Moreover, as understood by the skilled artisan, it may be possible to employ sleeves of various shapes and weights having shapes corresponding thereto, as long as precision of location and secure positioning are obtained.

I claim:

1. In a golf club denominated a driver and having a handle, a shaft communicating with the handle, and a clubhead attached to the shaft at the end thereof which is opposite to the handle, the clubhead having a top, a bottom, a heel, and a toe; the improvement therein for eliminating natural swing problems of a user or effecting a desired change in the flight pattern of a golf ball when struck by the driver, the improvement therein comprising:

a. a first weight located within the clubhead;

b. a first means for adjusting the position of the first weight in an essentially vertical direction within the clubhead, that is, from the top to the bottom thereof, c. a second weight located within the clubhead; and d. a second means for adjusting the position of the second weight in an essentially horizontal direction within the clubhead, that is, from the heel to the toe thereof;

wherein the first means comprises a first sleeve which is securely positioned essentially vertically within the clubhead and extending from the top to the bottom of the clubhead, the first sleeve having a first threaded shaft for receiving and advancing or retracting the first weight therein, the first weight having threads thereon which mesh with threads of the first threaded shaft of the first sleeve; and wherein the second means comprises a second sleeve which is securely positioned essentially horizontally within the clubhead and extending from the heel to the toe thereof, the second sleeve having a second threaded shaft for receiving and advancing or retracting the second weight therein, the second weight having threads thereon which mesh with threads of the second threaded shaft of the second sleeve; and wherein the first threaded shaft includes a threaded area as well as an unthreaded area therein, the unthreaded area thereof being located within the first shaft adjacent to a point of attachment of the first sleeve to the interior of the clubhead, the unthreaded area of the first shaft terminating in a first access port hole; and wherein the second threaded shaft includes a threaded area as well as an unthreaded area therein, the unthreaded area thereof being located within the second shaft adjacent to a point of attachment of the second sleeve to the interior of the clubhead, the unthreaded area of the second shaft terminating in a second access port hole.

2. The improvement of claim 1, wherein the first access port hole and the second access port hole are closed with a first access port hole cap and a second access port hole cap, respectively.

3. The improvement of claim 1, which additionally comprises a cooperating adjustment tool having a handle, a shaft communicating with the handle, and an adjustment end located on the shaft at the end thereof which is opposite to the handle, the adjustment end adapted to engage screw heads located on the first and second weights respectively, so that the first and second weights may be advanced or retracted through the first and second threaded shafts, respectively, by a golfer.

4. The improvement of claim 3, wherein the shaft of the adjustment tool is provided with markings thereon which allow the golfer to know exactly the position of a weight within a sleeve inside the clubhead.

* * * * *